US006083054A

United States Patent [19]

Suzuki et al.

[11] Patent Number: 6,083,054

[45] Date of Patent: Jul. 4, 2000

[54] BULB SOCKET AND METHOD FOR MANUFACTURING THE SAME

[75] Inventors: Takanori Suzuki; Kihachiro Uchida, both of Shizuoka, Japan

[73] Assignees: Yazaki Corporation; Koito Manufacturing Co., Ltd., both of Tokyo, Japan

[21] Appl. No.: 09/163,158

[22] Filed: Sep. 30, 1998

[30] Foreign Application Priority Data

Sep. 30, 1997 [JP] Japan ..... 9-267131

[51] Int. Cl.[7] ..... H01R 17/00

[52] U.S. Cl. ..... 439/699.2; 29/883

[58] Field of Search ..... 439/699.2, 350–356, 439/357, 358, 348; 29/883, 884

[56] References Cited

U.S. PATENT DOCUMENTS 5,729,898 3/1998 Ogawa ..... 29/883

FOREIGN PATENT DOCUMENTS 0 740 475 A2 10/1996 European Pat. Off. .
63-99777 6/1988 Japan ..... H01R 13/42
3-210781 9/1991 Japan ..... H01R 33/09
9-17533 1/1997 Japan ..... H01R 33/09

*Primary Examiner*—Khiem Nguyen
*Assistant Examiner*—Eugene G. Byrd
*Attorney, Agent, or Firm*—Sughrue, Mion, Zinn, Macpeak & Seas, PLLC

[57] ABSTRACT

In the bulb socket 1 according to the invention, the connecting terminal 4 to be insert molded within the bulb insertion portion 2 includes the three surfaces, that is, the two side walls 5, 6 having a substantially L-like shape as a whole and the bottom wall 7. In one side wall 5, there are provided not only contact piece 8 and securing piece 9 which can be respectively contacted with the bulb wedge, but also the inflow preventive piece 11 which prevents the flowing-around molding material from flowing into the bulb storage portion 10 and also can strengthen the fixation of the connecting terminal 4 within the bulb insertion portion 2. Also, when molding the bulb socket 1, the fall preventive cores 20 to prevent the deformation of the side walls 5 and 6 are inserted into the bulb storage portion 10 and also into the peripheral portions of the bulb storage portion 10 and, at the same time, the leading end portion 11*a* of the inflow preventive piece 11 is insert molded within the bulb socket 1.

4 Claims, 5 Drawing Sheets

BULB SOCKET AND METHOD FOR MANUFACTURING THE SAME

BACKGROUND OF THE INVENTION

1. Field of the Invention

The present invention relates to a bulb socket for a wedge base bulb for use in an automobile lamp device and, in particular, to such bulb socket which is improved in the structure of a connecting terminal to be insert molded into the bulb socket and a method for manufacturing the same.

2. Related Art

Conventionally, as a bulb socket which is used for connection of lamp devices in an automobile or the like, there are known various bulb sockets. As an example of the conventional bulb sockets, description will be given below of a bulb socket which is disclosed in Japanese Patent Publication No. Hei. 9-17533 (Shinji).

That is, in a conventional bulb socket 31 shown in FIG. 6, a bulb insertion portion 41 and a connector plug portion 46 are disposed in an L-shaped manner. At first, as a portion which corresponds to the bulb insertion portion 41, there is molded a bottomed and cylindrical-shaped cylindrical body 34. The cylindrical body 34 is formed in such a manner that a connecting terminal 36 formed of a conductive body such as a phosphor bronze plate or the like is inserted into the mother structure of the cylindrical body 34 and then the mother structure is molded of insulating molding material such as nylon resin together with the thus inserted connecting terminal 36.

As shown in FIG. 7, the connecting terminal 36 includes a wall plate portion 36*a* which extends along the inner wall surface of the cylindrical body 34 and, a portion of the wall plate portion 36*a* is inwardly cut and raised to thereby provide a hold piece 36*b* in such a manner that it can be flexed and deformed; that is, the hold piece 36*b* can be contacted with the side surface of a wedge base bulb disposed opposed thereto, thereby preventing the play or free motion of the connecting terminal 36. Also, one side edge of the wall plate portion 36*a* is bent at right angles to thereby provide a pair of mutually parallel arranged elastic contact piece 36*d* and elastic securing piece 36*c* which respectively function as electrode terminals. Further, in the connecting terminal 36, there is provided a contact tab 36*e* which is projected from the end edge of the portion of the wall plate portion 36*a* in which the elastic contact piece 36*d* is provided. The contact tab 36*e* is formed in the following manner: that is, after it is inserted into and projected from the cylindrical body 34, it is bent at right angles and the leading end thereof is then projected into the connector plug portion 46.

Referring further to an outer shell body 33 shown in FIG. 6, the outer shell body 33 is formed of the same material as the cylindrical body 34 and includes a square-cylindrical-shaped outer cylinder 40 which is used to cover the outer side surface and bottom surface of the cylindrical body 34, while the cylindrical body 34 and outer cylinder 40 cooperate together in forming the bulb insertion portion 41.

In the bulb insertion portion 41 of the bulb socket 31, if the wedge of the bulb is contacted with the elastic contact piece 36*d* of the connecting terminal 36 and is also secured to the elastic securing piece 36*c* thereof, and, at the same time, if a mating connector connected to a power source system is inserted into the connector plug portion 46, then the contact tab 36*e* comes into contact with its mating connecting terminal, so that the bulb can be connected to the power source system electrically.

Next, description will be given below of a procedure for molding the bulb socket 31. At first, the cylindrical body 34 is primarily molded using a metal mold (not shown). Next, the thus molded cylindrical body 34 is set within another metal mold for molding the bulb socket 31 and is then insert molded together with the bulb socket 31 within the metal mold. That is, firstly, the connecting terminal 36 is set within a separate metal mold and molding material is then poured into the present metal mold to thereby mold the cylindrical body 34; and, next, the cylindrical body 34 is set as a core in a metal mold for molding the outer shell body 33 and is then insert molded there, so that the bulb socket 31 can be molded.

Accordingly, the shape of an in-flow preventive core used to prevent the molding material from flowing into a bulb storage portion 49 in which the elastic contact piece 36*d*, elastic securing piece 36*c* and hold piece 36*b* are located can be so formed as to have a relatively simple structure, and such simple structure is capable of coping easily with a change in the design of the bulb storage portion 49 as well.

Also, since the connecting terminal 36 has been already molded as a core within the outer cylinder 40 at the time when molding the outer shell body 33, there is no possibility that the inflow pressure of the molding material can bring down and deform the metal plate of the connecting terminal 36 inwardly to thereby manufacture an inferior or defective bulb socket.

However, in the above-mentioned conventional bulb socket 31, since the outer cylinder 40 core portion and the outer shell 33 portion must be molded in two stages, the number of man-hour is large, which results in the lowered operation efficiency and increased manufacturing cost of the bulb socket.

Also, when the bulb socket is a small-sized one, the connecting terminal is so formed in structure as to include three U-shaped side plates and a bottom plate and, inside the two mutually opposed side plates, there is interposed an elastic contact piece which can be contacted with a bulb wedge. When molding the bulb socket, if the bulb storage portions of two connecting terminals are insert molded while they are opposed to each other, then the molding material is prevented from flowing into the bulb storage portions.

However, in the connecting terminal of a bulb socket for a large-sized wedge base bulb, an elastic contact piece and an elastic securing piece are provided on one side wall of the connecting terminal. Therefore, the above-mentioned structure of the bulb socket for the small-sized bulb cannot be applied as it is to the large-sized bulb.

SUMMARY OF THE INVENTION

The present invention aims at eliminating the above-mentioned problems found in the conventional bulb sockets. Accordingly, it is an object of the invention to provide a bulb socket for a large-sized wedge base bulb which allows a connecting terminal to be insert molded by means of a single molding operation, can prevent the molding material from flowing into the bulb storage portion, and permits use of a fall preventive core to prevent the falling of the connecting terminal due to the inflow pressure of the molding material.

According to the invention, the above object can be attained by the following articles 1) to 3).

1) A bulb socket formed of insulating molding material and including in one end thereof a bulb insertion portion to which a bulb can be detachably connected and in the other end portion thereof a connector plug portion to which a connector can be detachably connected, in which a connecting terminal formed of conductive material and insert moldable within the bulb insertion portion is composed of two side walls and a bottom wall, a contact tab projecting into the connector plug portion is provided on one of the side walls, and a contact tab projecting into the connector plug portion is provided on the bottom wall, characterized by an inflow preventive piece provided in the end portion of one side wall not only for preventing the molding material, which flows when the bulb socket is molded, from flowing into the bulb storage portion of the bulb insertion portion but also for strengthening the fixation of the connecting terminal within the bulb insertion portion.

2) A bulb socket as set forth in the above article 1), in which an elastic play preventive piece for holding a bulb wedge is provided on the other side wall which is a partner with the above-mentioned one side wall.

3) A method for manufacturing a bulb socket formed of insulating molding material and comprising in one end thereof a bulb insertion portion to which a bulb can be detachably connected and in the other end portion thereof a connector plug portion to which a connector can be detachably connected, while a connecting terminal formed of conductive material and insert moldable within the bulb insertion portion is composed of a substantially L-shaped side wall and a bottom wall, characterized in that, when the bulb socket is molded, fall preventive cores for preventing the side wall from falling are inserted into the bulb storage portion of the bulb insertion portion and also into the peripheral portions of the bulb storage portion, and the leading end portion of the inflow preventive piece provided on the connecting terminal side in order to prevent the inflow of the molding material into the bulb storage portion is insert molded within the bulb socket.

According to the above structured bulb socket, since there is provided the inflow preventive piece for preventing the molding material, which flows when the bulb socket is molded, from flowing into the bulb storage portion and also for strengthening the fixation of the connecting terminal within the bulb insertion portion, the molding material of the connecting terminal insert molded when the bulb socket is molded can be surely prevented from flowing into the bulb storage portion. Therefore, a highly reliable product or bulb socket can be obtained by means of a single molding operation. This not only can improve the operation efficiency but also can reduce the number of man-hour and thus can reduce the cost of the bulb socket.

Also, because the elastic play preventive piece for holding the bulb wedge is provided on the other side wall which is a partner with the above-mentioned one side wall, the play of the connecting terminal due to the vibratory motion of the bulb after inserted can be prevented to thereby prevent poor conduction or breaking of a filament, which can improve the reliability of the bulb socket further.

Further, when the bulb socket is molded, the fall preventive cores for preventing the side wall from falling are inserted into the bulb storage portion of the bulb insertion portion and into the peripheral portions of the bulb storage portion and the leading end portion of the inflow preventive piece provided on the connecting terminal side in order to prevent the inflow of the molding material into the bulb storage portion is insert molded within the bulb socket. This not only prevents the connecting terminal from being brought down and deformed inwardly due to the inflow pressure of the molding material but also can fix the connecting terminal within the bulb socket due to provision of the inflow preventive piece. As a result of this, the reliability of the bulb socket molded can be improved still further.

DETAILED DESCRIPTION OF PREFERRED EMBODIMENT OF INVENTION

Figure 1:
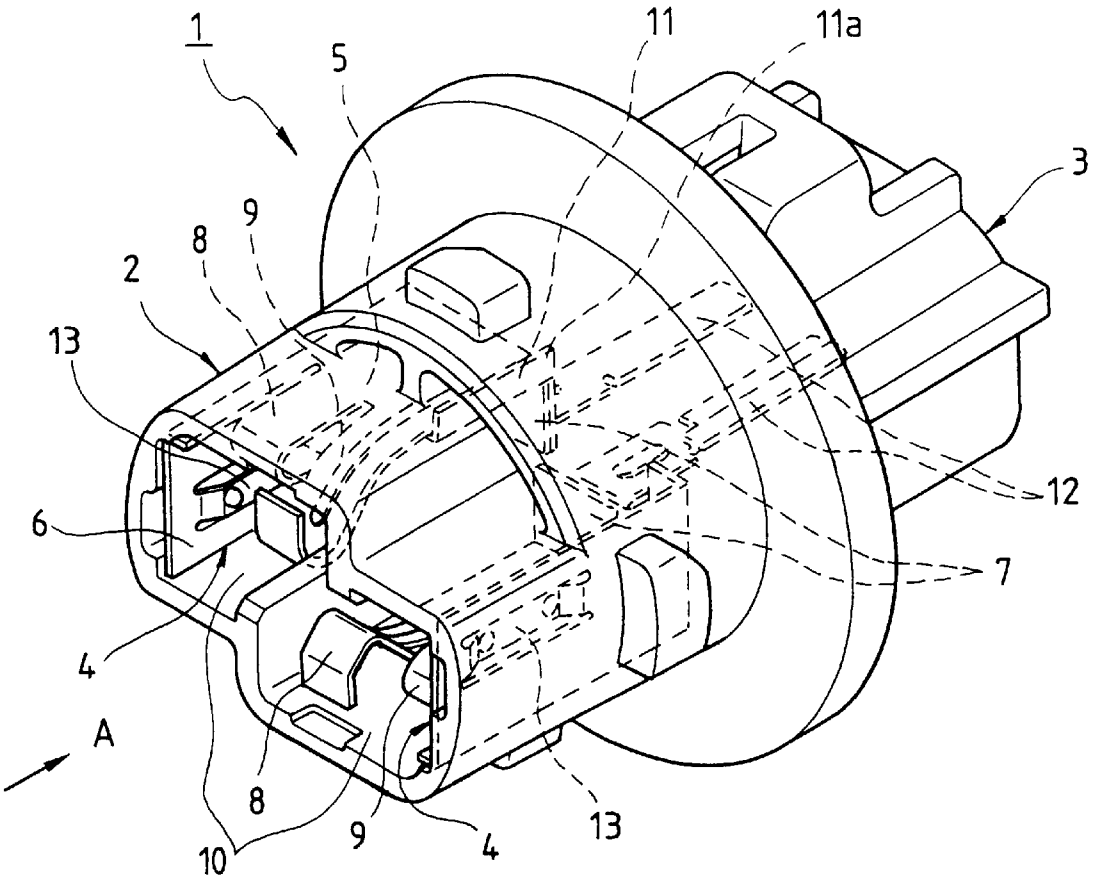
FIG. 1 is a perspective view of an embodiment of a bulb socket according to the invention.
Figure 2:
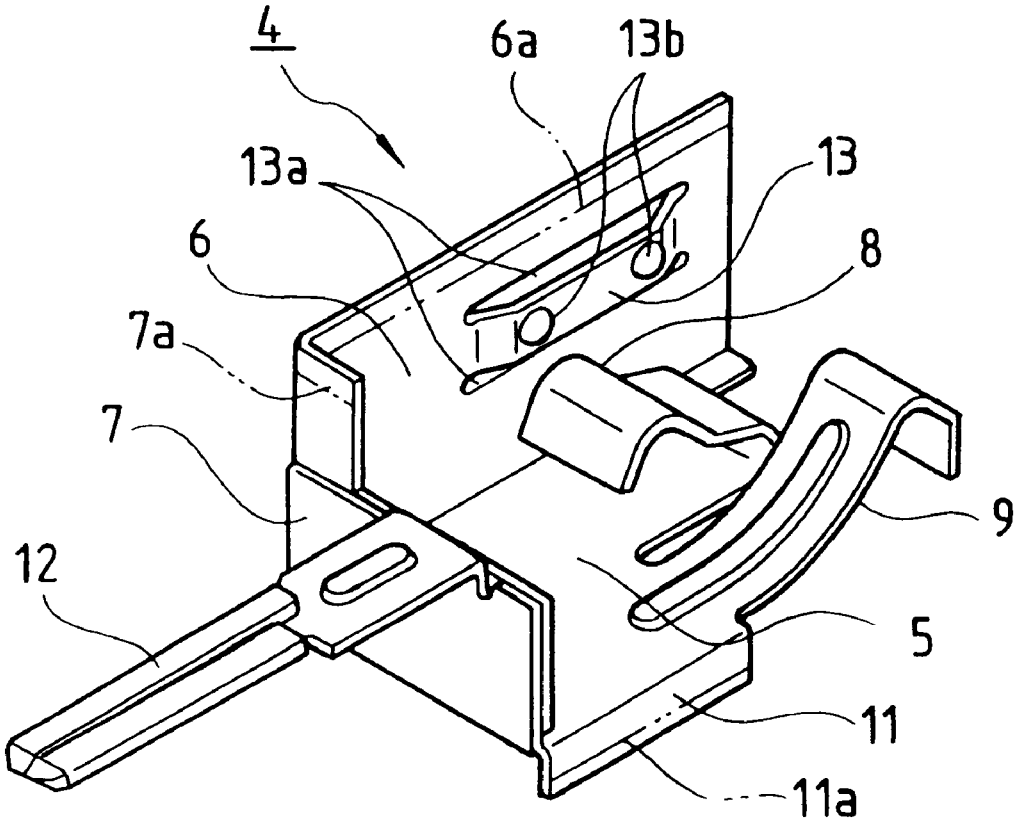
FIG. 2 is a perspective view of a connecting terminal shown in FIG. 1.
Figure 4:
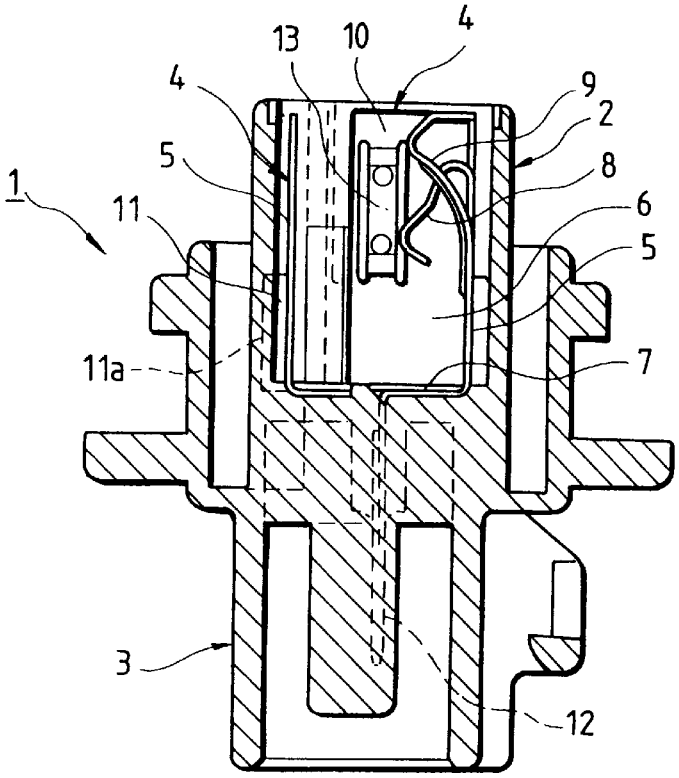
FIG. 4 is a section view taken along the line B—B shown in FIG. 3, showing a state in which a fall preventive core is removed.
Figure 5:
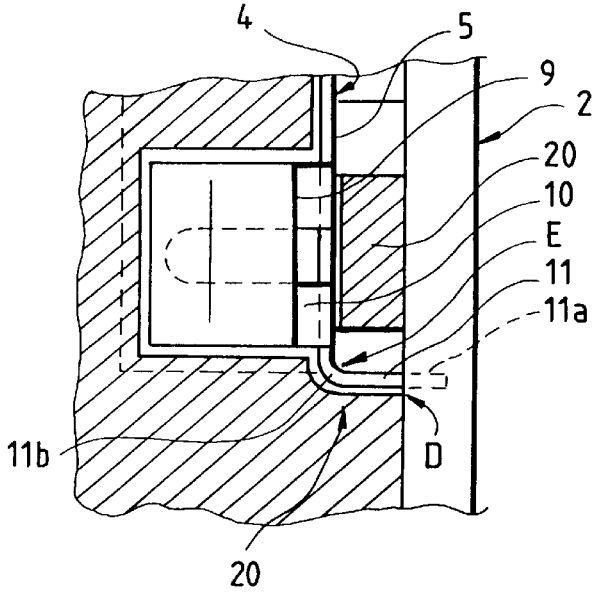
FIG. 5 is an enlarged explanatory view of the portion C shown in FIG. 3.

Now, description will be given below in detail of an embodiment of a bulb socket and a method for manufacturing the same according to the invention with reference to FIGS. 1 to 5. In particular, FIG. 1 is a perspective view of an embodiment of a bulb socket according to the invention, FIG. 2 is a perspective view of a connecting terminal shown in FIG. 1, FIG. 3 is a view taken along the arrow line A shown in FIG. 1, showing a state in which a fall preventive core is mounted, FIG. 4 is a section view taken along the line B—B shown in FIG. 3, showing a state in which the fall preventive core is removed, and FIG. 5 is an enlarged explanatory view of the C portion shown in FIG. 3.

As shown in FIGS. 1 to 5, a bulb socket 1 according to the present embodiment is formed of insulating molding material such as nylon resin or the like; and, in one end portion thereof, there is formed a bulb insertion portion 2 to which a bulb can be connected detachably and, in the other end portion thereof, there is formed a connector plug portion 3 to which a connector can be connected detachably. A connecting terminal 4, which is to be insert molded within the bulb insertion portion 2 and is formed of conductive material such as phosphor bronze or the like, includes three surfaces, that is, two side walls 5, 6 having a substantially L-like shape as a whole and a bottom wall 7; and, the connecting terminal 4 further includes in one side wall 5 a springy contact piece 8 and a springy securing piece 9 which can be respectively contacted with a bulb wedge. Also, in the bottom wall 7, there is provided a contact tab 12 which extends up to the connector plug portion 3.

And, in the connecting terminal 4, there is provided an inflow preventive piece 11 which is used not only to prevent the molding material, which flows around when molding the bulb socket 1 or the connecting terminal 4, from flowing into a bulb storage portion 10 but also to strengthen the fixation of the connecting terminal 4 within the bulb insertion portion 2. Also, on the other side wall 6 which is a partner with one side wall 5, there is provided an elastic play preventive piece 13 which is used to hold the bulb wedge. The play preventive piece 13 is structured in such a manner that there are formed two parallel elongated holes 13*a*, the central portions thereof are bulged inwardly, and two spherical-shaped contacts 13*b* are formed in the projecting ends of the contacts 13*b*.

Figure 3:
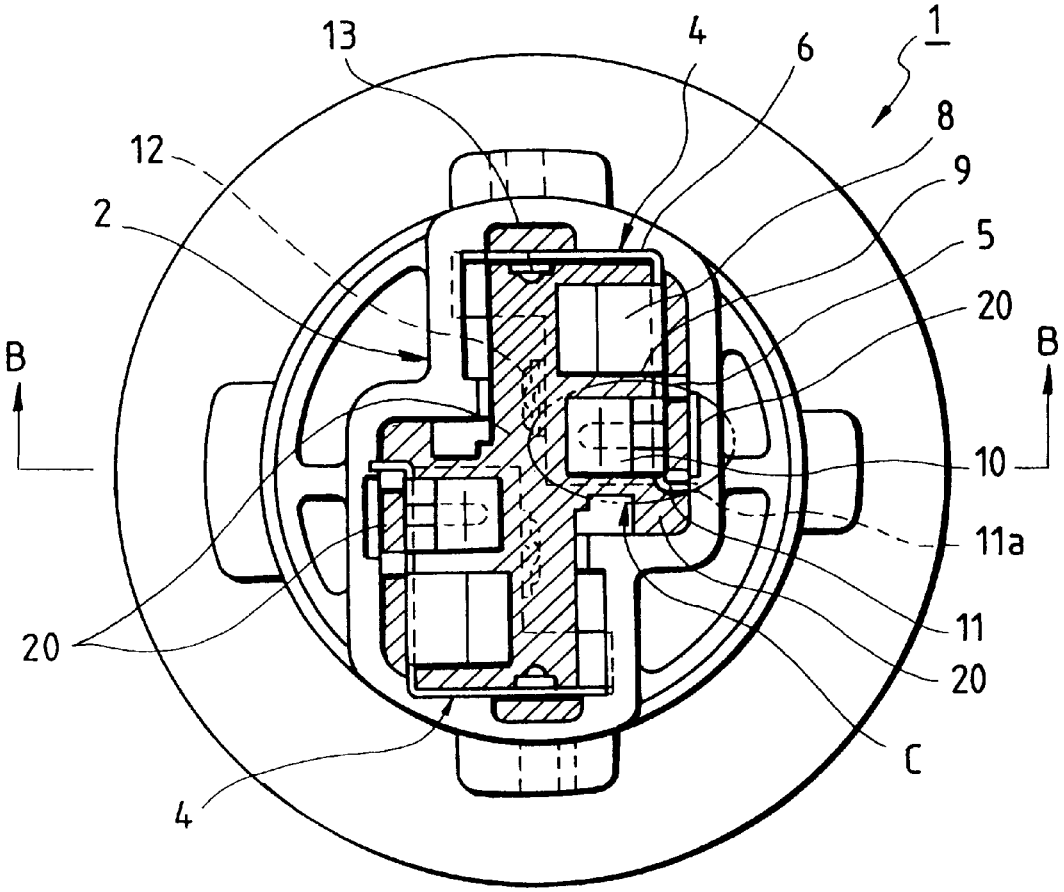
FIG. 3 is a view taken along the arrow line A shown in FIG. 1, showing a state in which a fall preventive core is mounted.

In the bulb socket 1 having the above-mentioned structure, as shown in FIG. 3, when molding the same, after two connecting terminals 4 are set within a metal mold, not only fall preventive cores 20 for prevention of the two side walls 5 and 6 are inserted into the bulb storage portion 10 and the peripheral portions of the bulb storage portion 10 but also the leading end portion 11*a* of the inflow preventive piece 11 is insert molded within the bulb socket 1. In this molding operation, as shown in FIG. 5, the molding material, which is going to flow into the bulb storage portion 10 from a direction of an arrow D, is stopped in the entrance of a slight gap 21 formed between the inflow preventive piece 11 and fall preventive core 20 and is thereby prevented from flowing into the bulb storage portion 10. Also, the molding material, which is going to flow into the bulb storage portion 10 from a direction of an arrow E, is stopped by the bent portion 11*b* of the inflow preventive piece 11 and fall preventive core 20 and is thereby prevented from flowing into the bulb storage portion 10.

By the way, as shown in FIG. 2, as the portion of the connecting terminal 4 that is insert molded by means of the molding material, besides the leading end portion 11*a* of the inflow preventive piece 11, there are also included the leading end portion 6*a* of the side wall 6 and the leading end portion 7*a* of the bottom wall 7 continuously connected with the leading end portion 6*a*. Due to this, the connecting terminal 4 can be fixed very strongly to the molding material of the bulb socket 1.

In the above-structured bulb socket 1 according to the present embodiment, the connecting terminal 4 includes the three surfaces, that is, the two substantially L-shaped side walls 5, 6 and the bottom surface 7; and, in one side wall 5, there are provided not only the contact piece 8 and securing piece 9 which can be respectively contacted with the bulb wedge but also the inflow preventive piece 11 which, during the molding operation, prevents the molding material from flowing into the bulb storage portion 10 and also strengthens the fixation of the connecting terminal 4 within the bulb insertion portion 2. That is, since the molding material of the connecting terminal 4, which is inserted together with the fall preventive core 20 when the bulb socket is molded, is prevented from flowing into the bulb storage portion 10 of the bulb insertion portion 2, there can be obtained a highly reliable bulb socket by means of a single molding operation. This not only can improve the operation efficiency in manufacturing the bulb socket but also can reduce the number of man-hour and thus reduce the cost of the bulb socket.

Also, because the elastic play preventive piece 13 for holding the bulb wedge is provided on the other side wall 6 which is a partner with one side wall 5, the play of the bulb wedge due to the vibratory motion of the bulb after inserted can be prevented, which in turn can prevent poor conduction and breaking of a filament. As a result of this, the reliability of the bulb socket can be improved further.

Further, in the bulb socket molding operation, the fall preventive cores 20 to prevent the falling and deformation of the side walls 5 and 6 of the connecting terminal 4 are inserted into the bulb storage portion 10 of the bulb insertion portion 2 and also into the peripheral portions of the bulb storage portion 10 and, at the same time, the leading end portion 11*a* of the inflow preventive piece 11 is insert molded within the bulb socket 1.

Thanks to this, the connecting terminal 4 can be prevented from being deformed inwardly due to the inflow pressure of the molding material, and the connecting terminal 4 can be fixed strongly within the bulb socket 1 due to the insert molded leading end portion 11*a* of the inflow preventive piece 11. As a result, the reliability of the bulb socket can be improved still further.

Figure 6:
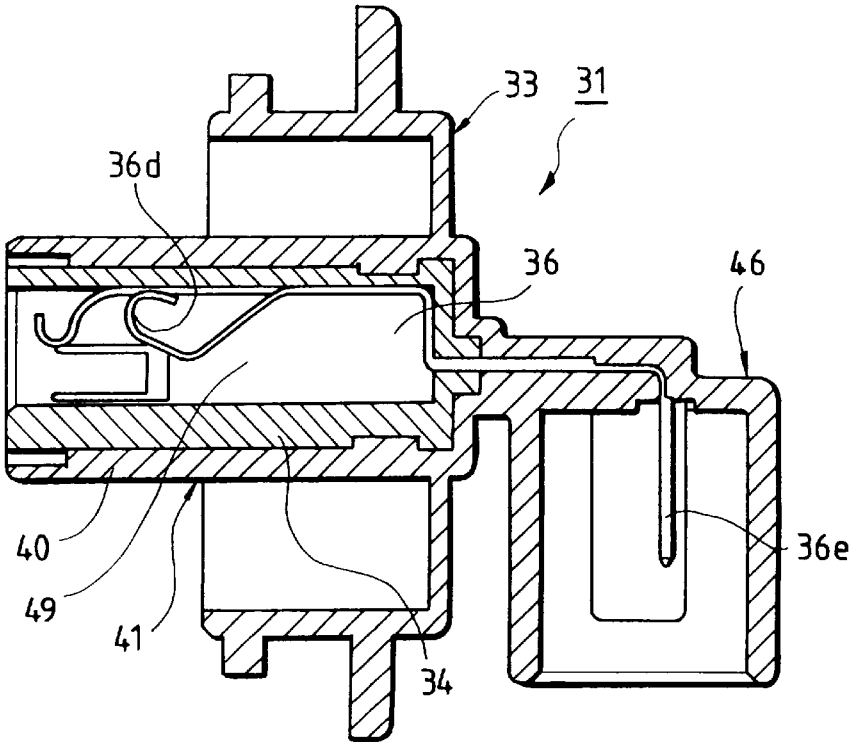
FIG. 6 PRIOR ART
FIG. 6 is a section view of an example of a conventional bulb socket.
Figure 7:
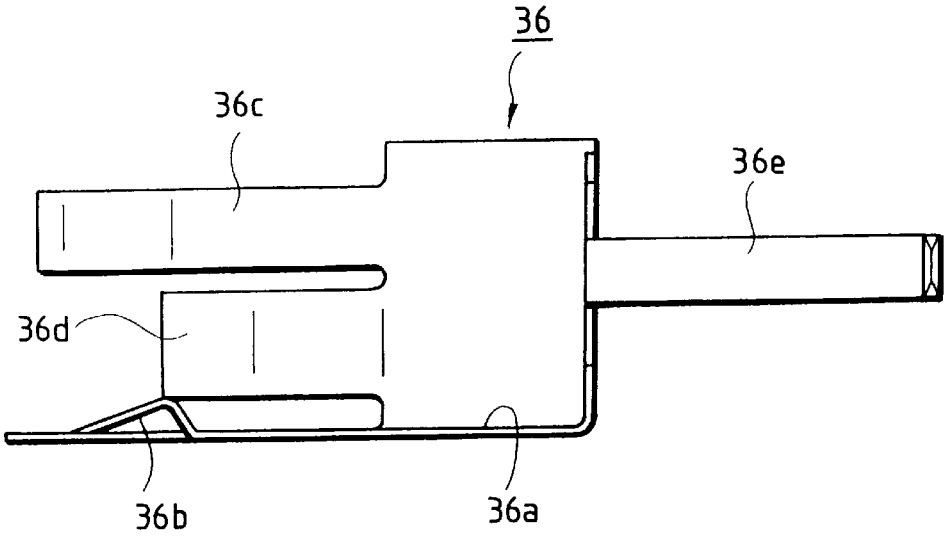
FIG. 7 PRIOR ART
FIG. 7 is a side view of a connecting terminal shown in FIG. 6.

However, the invention is not limited to the above-mentioned embodiment but it can also be enforced in other embodiments by changing or modifying the same properly. For example, in the present embodiment, there is employed a so called in-line type structure in which the bulb insertion portion 2 and connector plug portion 3 of the bulb socket 1 are arranged in a straight line; but, according to the invention, it is also possible to employ such an angle type structure as shown in FIG. 6.

As has been described heretofore, according to the bulb socket of the invention, there is provided the inflow preventive piece not only to prevent the molding material, which flows around when the bulb socket is molded, from flowing into the bulb storage portion but also to be able to strengthen the fixation of the connecting terminal within the bulb insertion portion. Therefore, the molding material of the connecting terminal, which is inserted in the bulb socket molding operation, can be positively prevented from flowing into the bulb storage portion, which makes it possible to obtain a highly reliable product or bulb socket by means of a single molding operation. This not only can improve the operation efficiency in manufacturing the bulb socket but also can reduce the number of man-hour and thus reduce the cost of the bulb socket.

Also, because the elastic play preventive piece for holding the bulb wedge is provided on the other side wall which is a partner with the above-mentioned one side wall, the play of the bulb wedge due to the vibratory motion of the bulb after inserted can be prevented, which in turn can prevent poor conduction and breaking of a filament. As a result of this, the reliability of the bulb socket can be improved further.

Further, in a method for manufacturing a bulb socket according to the invention, when molding the bulb socket, the fall preventive cores to prevent the falling and deformation of the two side walls are inserted into the bulb storage portion of the bulb insertion portion and the peripheral portions of the bulb storage portion and, at the same time, to prevent the inflow of the molding material into the bulb storage portion, the leading end portion of the inflow preventive piece provided on the connecting terminal side is insert molded within the bulb socket.

Thanks to this, the connecting terminal can be prevented from being deformed inwardly due to the inflow pressure of the molding material, and the connecting terminal can be fixed strongly within the bulb socket due to the insert molded leading end portion of the inflow preventive piece. As a result, the reliability of the bulb socket can be improved still further.

What is claimed is:

1. A bulb socket formed of insulating molding material, and comprising:

a bulb insertion portion to which a bulb is detachably connected;

a connector plug portion to which a connector is detachably connected;

a connecting terminal made of conductive material and defined by first and second side walls and a bottom wall, said connecting terminal being inserted and fixed within said bulb insertion portion;

a contact piece, formed on said first side wall, which is operative to contact a bulb wedge;

a contact tab provided on said bottom wall and projecting into said connector plug portion for contacting said connector; and an inflow preventive piece, provided on an end portion of said first side wall which prevents said molding material from flowing into a bulb storage portion of said bulb insertion portion during fabrication of said bulb socket, and which strengthens the fixation of said connecting terminal to said bulb insertion portion.

2. A bulb socket formed of insulating molding material according to claim 1, further comprising:

an elastic play preventive piece provided on said second side wall and which is operative to contact said bulb wedge to reduce vibratory motion on said bulb.

3. A method of manufacturing a bulb socket formed of insulating molding material, wherein said bulb socket comprises a bulb insertion portion to which a bulb is detachably connected, a connector plug portion to which a connector is detachably connected, a connecting terminal formed of conductive material and insert moldable within said bulb insertion portion, wherein said connecting terminal is defined by a substantially L-shaped side wall and a bottom wall, comprising the steps of:

(a) inserting fall preventive cores into a bulb storage portion of said bulb insertion portion and into the peripheral portions of said bulb storage portion, respectively, when said bulb socket is molded, to prevent said side walls from falling during fabrication; and (b) insert molding a leading end portion of an inflow preventive piece of said connecting terminal into said bulb socket, to prevent an inflow of said molding material into said bulb storage portion.

4. The method according to claim 3, wherein said bulb socket is manufactured using a single molding operation.

* * * * *